US008230551B2

(12) United States Patent
Borgerink et al.

(10) Patent No.: US 8,230,551 B2
(45) Date of Patent: Jul. 31, 2012

(54) HANDGRIP ASSEMBLY FOR A SUCTION ATTACHMENT

(75) Inventors: Carol Ann Borgerink, Albergen (NL); Bo Wang, Suzhou (CN); Wendeline Jans, Amsterdam (NL); Stefan Andreesen, Amsterdam (NL); Alexander P. J. De Visser, Vierhouten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/865,470

(22) PCT Filed: Jan. 28, 2009

(86) PCT No.: PCT/IB2009/050350

§ 371 (c)(1), (2), (4) Date: Nov. 11, 2010

(87) PCT Pub. No.: WO2009/098611

PCT Pub. Date: Aug. 13, 2009

(65) Prior Publication Data

US 2011/0047747 A1 Mar. 3, 2011

(30) Foreign Application Priority Data

Feb. 7, 2008 (EP) ..... 08151143

(51) Int. Cl.
*A47L 9/30* (2006.01)

(52) U.S. Cl. ..... 15/410; 15/319; 15/323; 15/339

(58) Field of Classification Search ..... 15/319, 15/339, 323, 410, 411; *A47L 9/30, 9/32*
See application file for complete search history.

(56) References Cited

U.S. PATENT DOCUMENTS

| | | | |
|---|---|---|---|
| 1,058,926 | A | 4/1913 | Toole |
| 4,958,407 | A | 9/1990 | Johnson |
| 5,149,160 | A | 9/1992 | Iida et al. |
| 2002/0116784 | A1 | 8/2002 | Sumner |
| 2003/0221280 | A1 | 12/2003 | Oh et al. |
| 2008/0301903 | A1 * | 12/2008 | Cunningham et al. ..... 15/410 |

FOREIGN PATENT DOCUMENTS

| | | | |
|---|---|---|---|
| EP | 0882422 | A1 | 12/1998 |
| EP | 1400317 | A1 | 3/2004 |
| GB | 2386054 | A | 9/2003 |
| JP | 08275910 | A | 10/1996 |
| JP | 2000070188 | A | 3/2000 |
| NL | 8104552 | | 5/1983 |
| WO | 8907412 | A1 | 8/1989 |
| WO | 9713444 | A1 | 4/1997 |
| WO | 0047101 | A1 | 8/2000 |
| WO | 0238022 | A1 | 5/2002 |
| WO | 2006049499 | A2 | 5/2006 |

* cited by examiner

*Primary Examiner* — David Redding

(57) ABSTRACT

A suction attachment for a vacuum cleaner includes a tube assembly, a first handgrip, and a second handgrip, respectively, both of which extend from the tube assembly. This provides two handgrip portions separate from the tube assembly, which improves its ergonomic handling.

12 Claims, 4 Drawing Sheets

HANDGRIP ASSEMBLY FOR A SUCTION ATTACHMENT

FIELD OF THE INVENTION

The present invention relates to a suction attachment for a vacuum cleaner comprising a suction nozzle and a tube assembly. The tube assembly is attached to the suction nozzle and defines a passageway in communication with the interior of the suction nozzle. Furthermore, the invention relates to a vacuum cleaner and a handgrip assembly.

BACKGROUND OF THE INVENTION

Known suction attachments are sometimes provided with a handgrip that extends from the tube assembly. Such a handgrip provides a handgrip portion which is separate from the tube assembly and generally facilitates handling of the suction attachment during cleaning.

The suction attachment with a handgrip as mentioned in the preceding paragraph has the drawback that it is difficult to obtain an ergonomic grip.

Generally, a user places one hand on the handgrip and the other hand at a lower position on the tube assembly. This has the drawback that one has to bend forward, or at least bend more as compared to gripping with one hand only. It should be noted that, during operation, the first handgrip portion is normally located somewhere above a respective portion of the tube assembly. Accordingly, the user should place his other hand somewhat lower, forcing him to bend forward. If a user has to bend continuously during vacuum cleaning, he can get back problems. It is known that the more one has to bend, the greater the risk to back problems, especially in the lower back region.

OBJECT AND SUMMARY OF THE INVENTION

It is an object of the present invention to provide a suction attachment that mitigates the above-mentioned drawbacks.

Accordingly, the present invention provides an autonomous suction attachment as defined in claim 1.

By providing two handgrips, both of which extend from the tube assembly and each of which has a handgrip portion that is separate from the tube assembly while the second handgrip extends from the tube assembly between the first handgrip and the suction nozzle, the flexibility to arrange two handgrip portions is created in an advantageous manner by adjusting the distance and the angle of the parts of both handgrips that extend from the tube assembly. An ergonomic grip, with one hand placed in front of the other at the same height level with respect to a surface to be cleaned, can then be obtained. This enables a user to take up a more upright posture. A user is thus spared from having to bend or at least from having to bend too much. Forces of both hands can be possibly transferred independently to the suction attachment via the respective handgrips.

Tests have indicated that the typical back-and-forth movement of the cleaning head can be realized in a more ergonomic way. The hands are kept closer to the upper body as compared to the use of known suction attachments. A user moves his hands sideways in front of his upper body rather than stretching and retracting his arms, as is the case when using known suction attachments.

In a preferred embodiment, the first or the second handgrip comprises a base part connected to the tube assembly and adapted to surround a respective portion of the tube assembly. This has the advantage that at least one of the handgrips having such a base part can be connected easily and firmly to the tube assembly by sliding it over a respective portion thereof and subsequently attaching the base part to the tube assembly. As the base part surrounds a respective portion of the tube assembly, a firm connection between both components can be established. It is preferred that both the first and the second handgrip comprise said base part, while both base parts are individually attached to the tube assembly.

In the embodiment described hereinbefore, it is even more preferred that the base part comprises a holder which is arranged to hold suction accessories in a detachable manner. This provides a simple solution for attaching various suction accessories to the tube assembly. Moreover, when the suction attachment is connected to the housing of a vacuum cleaner during the cleaning operation, a user no longer has to bend towards the housing to take the accessories. The accessories are usually accommodated in the housing of a vacuum cleaner. In this embodiment, a user can take them directly from the tube assembly.

In accordance with a preferred embodiment, the first and the second handgrip are arranged to hinge relatively to each other, wherein the first and the second handgrip hinge between an open position so as to provide said first and second handgrip portions, and a closed position in which the first and the second handgrip are combined so as to provide a unitary handgrip. This has the advantage that a user can choose between a more active position of both handgrips, with two separate handgrip portions for ergonomic handling, and a more compact position in which both handgrips occupy less space. The latter position is advantageous when storing the suction attachment.

In a preferred embodiment, the first and the second handgrip are arranged to adjust the distance between the handgrip portions and the tube assembly. This has the advantage that a user can adjust the height level of the handgrip portions relative to a surface to be cleaned.

In accordance with a preferred embodiment, the tube assembly comprises a rigid part connected to the suction nozzle, a flexible part for connection to the housing of a vacuum cleaner, and a bridging part for connecting the rigid part to the flexible part, respectively, the first handgrip being connected to the bridging part and the second handgrip being connected to the rigid part. A tube assembly having a rigid, flexible and bridging part is generally known.

It has been found that connection of the handgrip in this way allows maximization of the height of both handgrip portions relative to a surface to be cleaned. Moreover, it ensures a proper transfer of the forces to the suction attachment for maneuvering the suction nozzle. It is even more preferred that the flexible part is connected to the bridging part so as to allow rotation through a predefined range between the flexible part, on the one hand, and the bridging part and the first handgrip, on the other hand. This allows rotation of the handgrips and the suction nozzle relative to the flexible part, which improves handling of the suction attachment. This is especially advantageous when the suction attachment is connected to a vacuum cleaner. It was found that rotation in a predefined range of 180° creates sufficient flexibility while maintaining a good maneuverability. Furthermore, it is preferred that the bridging part has an extension which couples with the interior of the rigid part so as to attach the bridging part to the rigid part. This does not only facilitate attachment of both parts, but also gives a user the option of cleaning places that are difficult to reach by the cleaning nozzle, e.g. in tight spaces. A user then first detaches the bridging part from the rigid part and subsequently cleans with the extension while using the first handgrip only.

The present invention also relates to a vacuum cleaner as defined in claim 10. According to the invention, a user can ergonomically handle the vacuum cleaner.

The present invention further relates to a handgrip assembly as defined in claim 13. This handgrip assembly can be advantageously used to ergonomically handle a suction attachment.

The handgrips according to the present invention provide a handgrip portion separate from the tube assembly in the sense that such handgrip portions are located at a distance from the tube assembly itself. For example, a special casing or collar arranged around the tube assembly for providing a handgrip is not a handgrip separate from the tube assembly.

BRIEF DESCRIPTION OF THE DRAWINGS

Embodiments of the present invention will now be described by way of example and with reference to the accompanying drawings, in which.

DESCRIPTION OF EMBODIMENTS

Figure 1:
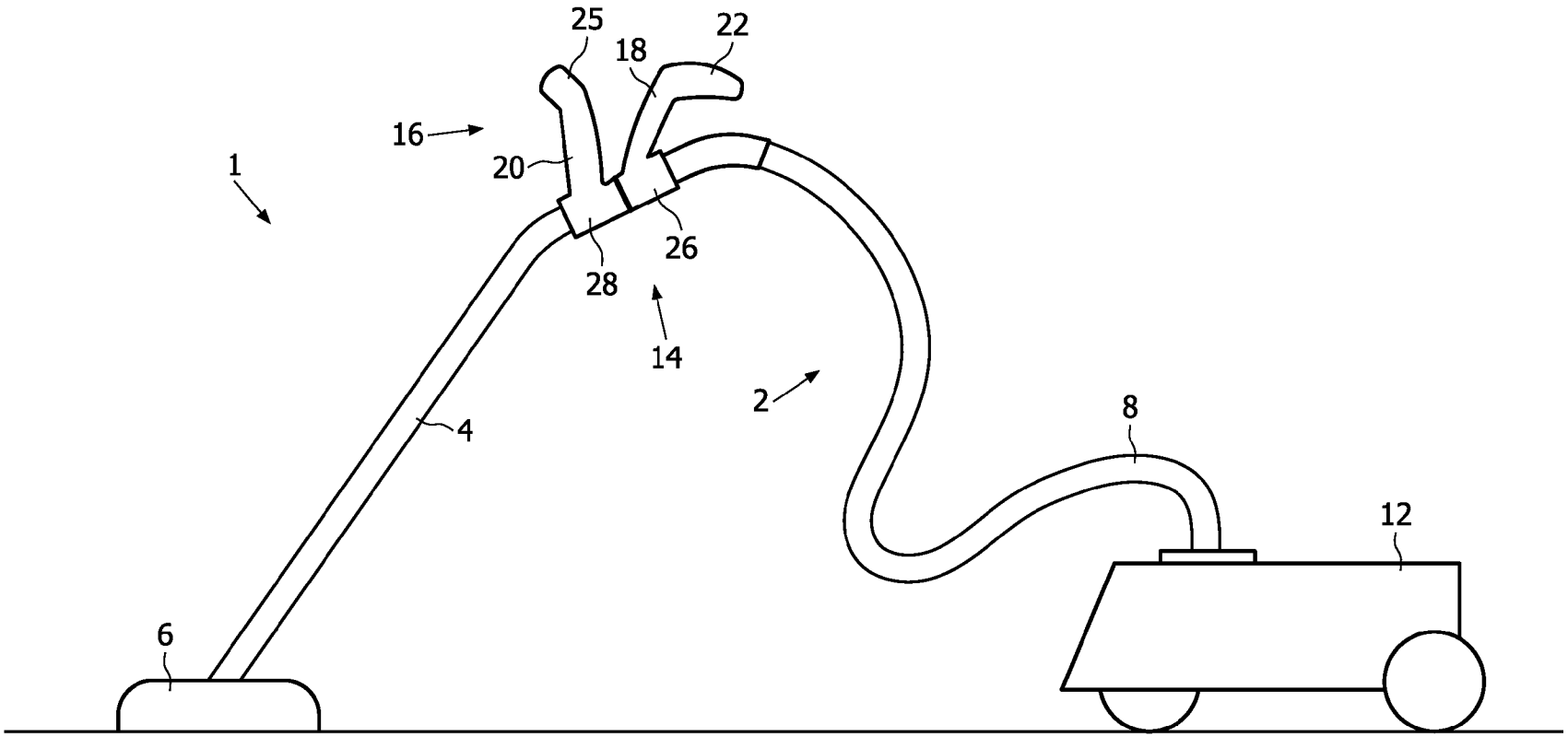
FIG. 1 is a schematic view of a suction attachment connected to the housing of a vacuum cleaner.
Figure 2:
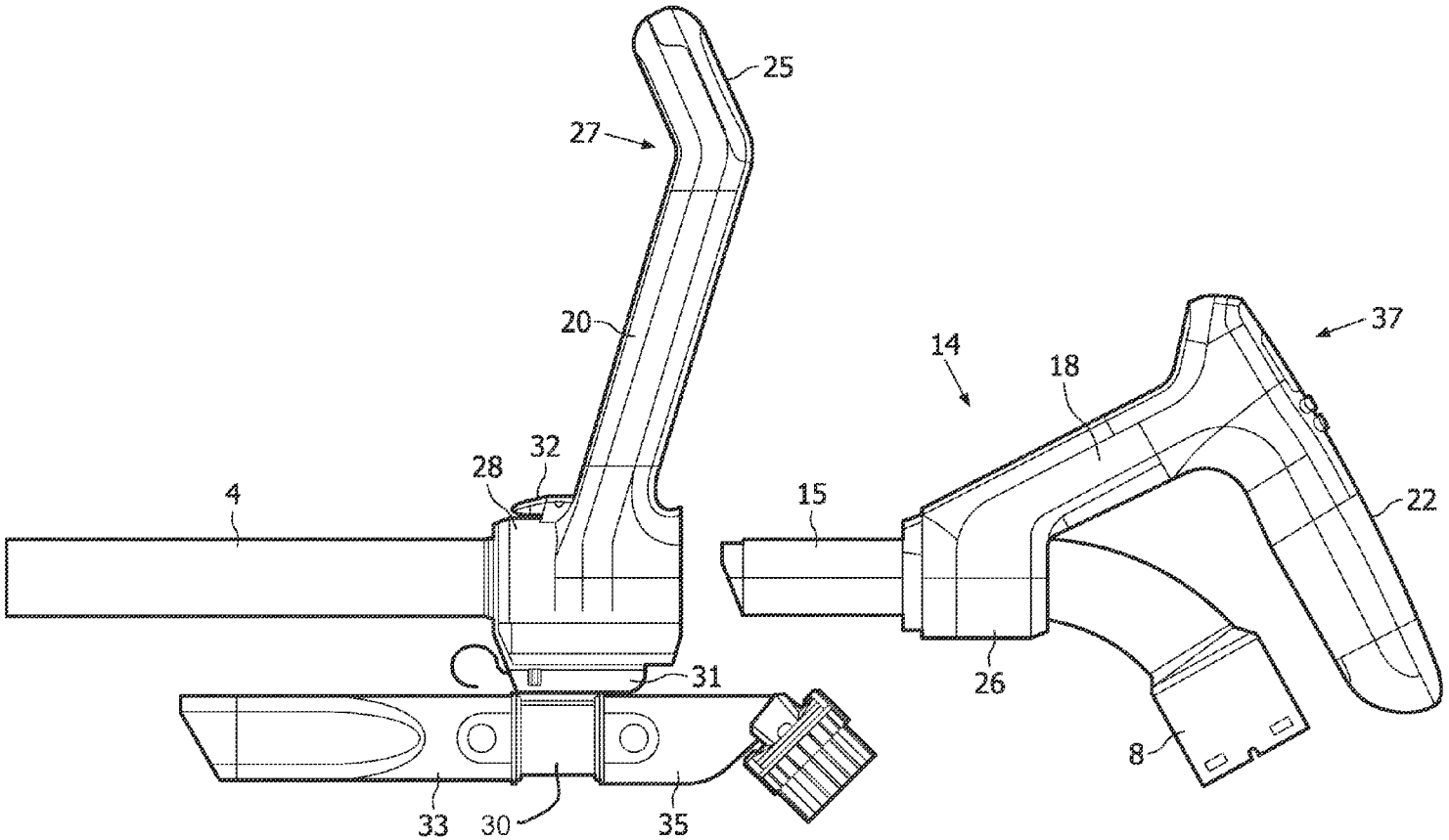
FIG. 2 is a schematic side view of a handgrip assembly connected to a tube assembly in accordance with a first embodiment, in a disassembled state.
Figure 3:
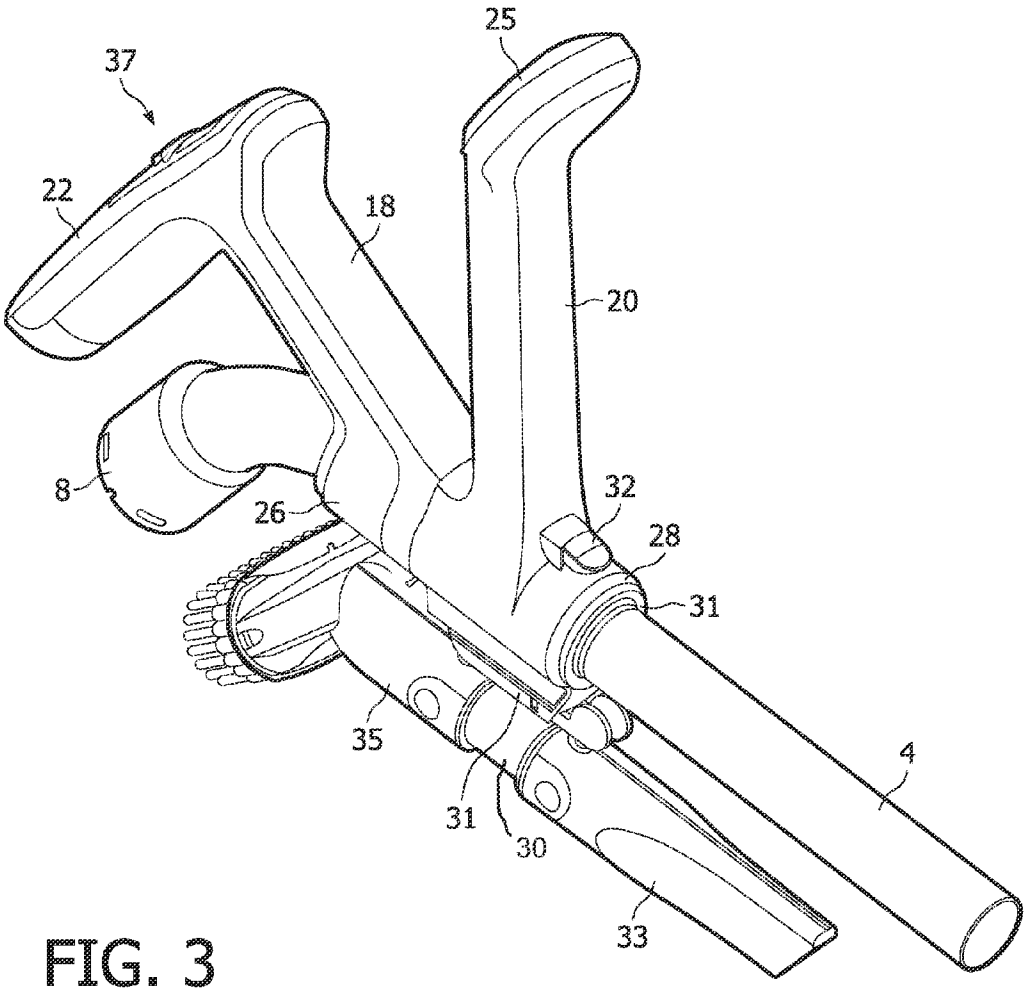
FIG. 3 is a perspective view of a handgrip assembly connected to a tube assembly in accordance with a first embodiment, in an assembled state.

FIGS. 1 to 3 show a suction attachment 1 in accordance with a first embodiment of the present invention. The suction attachment has a tube assembly 2 comprising a rigid part 4 connected to a suction nozzle 6, a flexible part 8 connected to the housing 12 of a vacuum cleaner, and a bridging part 14 for connecting the rigid part to the flexible part, respectively. The housing 12 accommodates at least a control unit for controlling the operation of the vacuum cleaner, an electrical suction unit for providing vacuum power and a dust container (none shown in any of the drawings). The electrical suction unit and the dust container communicate with the interior of the suction nozzle via the tube assembly 2 so as to suck particles from a surface, which are subsequently assembled in the dust container.

The suction attachment further comprises a handgrip assembly 16 having a first handgrip 18 and a second handgrip 20. The first handgrip 18 provides a first handgrip portion 22 separate from the tube assembly 2. Similarly, the second handgrip 20 provides a second handgrip portion 25 separate from the tube assembly 2. Both handgrips extend from the tube assembly over a certain length. The second handgrip has a bend 27 (see FIG. 2). It is possible for a user to grasp the second handgrip below the bend 27.

Both handgrips are preferably connected to the tube assembly via respective base parts 26, 28 which are adapted to surround a respective portion of the tube assembly 2. The base parts preferably have an interior space which has a substantially cylindrical shape so as to fit the tube assembly which is generally also cylindrical. The first handgrip 18 is connected to the bridging part 14 while the second handgrip 20 is connected to the rigid part 4. The first handgrip is not connected to the second handgrip directly. It is preferred if both base parts 26, 28 are aligned with each other when the bridging part 14 is connected to the rigid part 4 (see FIG. 3).

The base part 28 of the second handgrip 20 is attached by means of a special bush 31 which is fitted on one end of the rigid part 4. The base part 26 of the first handgrip 18 is fixed to the bridging part 14 in known manner. In the present embodiment, the first and second handgrips are attached permanently, or at least semi-permanently, to the respective parts of the tube assembly. However, it is also possible to attach both handgrips via some kind of easy-release mechanism.

It is not required per se to attach the first and second handgrips directly to each other. However, if this were done, it would reduce possible play between the respective parts during (severe) handling.

The flexible part 8 is connected to the bridging part 14 so as to allow a 180° rotation. Such a rotation improves the flexibility of handling the tube assembly.

A holder 30 is arranged to hold suction accessories 33, 35 in a detachable manner. The holder is preferably connected to the base part 28 or bush 31.

A knob 32 is arranged just above base part 28 so as to enable a user to release the connection between the base part, the bridging part 14 and the rigid part 4. This connection is made in a conventional manner, for example, by means of a ball-spring and recess assembly. The bridging part 14 has an extension 15 which fits in the interior of the rigid part 4. The extension 15 can also be used to clean areas that are difficult to reach for the nozzle 6. A user then first detaches the bridging part 14 from the rigid part 4 by pressing knob 32. Note that, in this preferred embodiment, the first and the second handgrip are not connected to each other. In FIG. 2, the suction attachment is shown in a disassembled state. When the bridging part is detached from the rigid part, only the first handgrip preferably remains attached to the bridging part. The holder 30 is preferably attached to the second handgrip.

There is such a distance between the first and the second handgrip that both hands of a user are in a comfortable position. This means that the two handgrips are located typically within less than 25 centimeters from each other.

The first handgrip comprises a control display 37 which has a wireless connection with the control unit in the housing 12 of the vacuum cleaner. The display has control buttons and a screen which can be used, for example, to show and adjust the power of the suction unit or suction motor.

The handgrips are preferably made of a plastic material. Due to strength requirements, a metal is preferably used for the hinge axis.

Figure 4B:
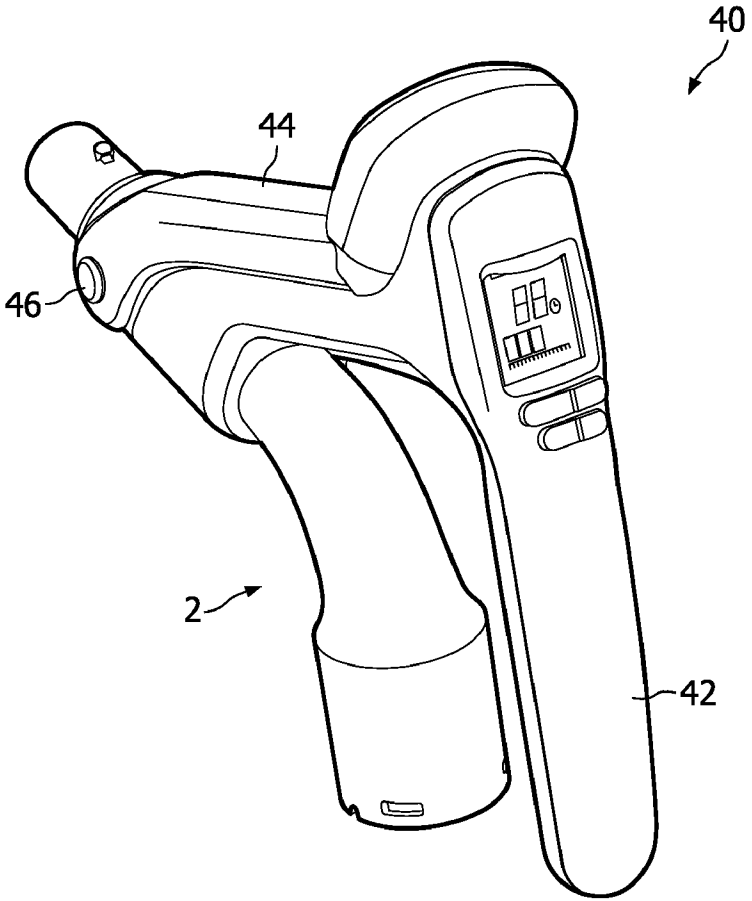
FIGS. 4A and B are perspective views of a handgrip assembly connected to a tube assembly in accordance with a second embodiment.
Figure 4A:
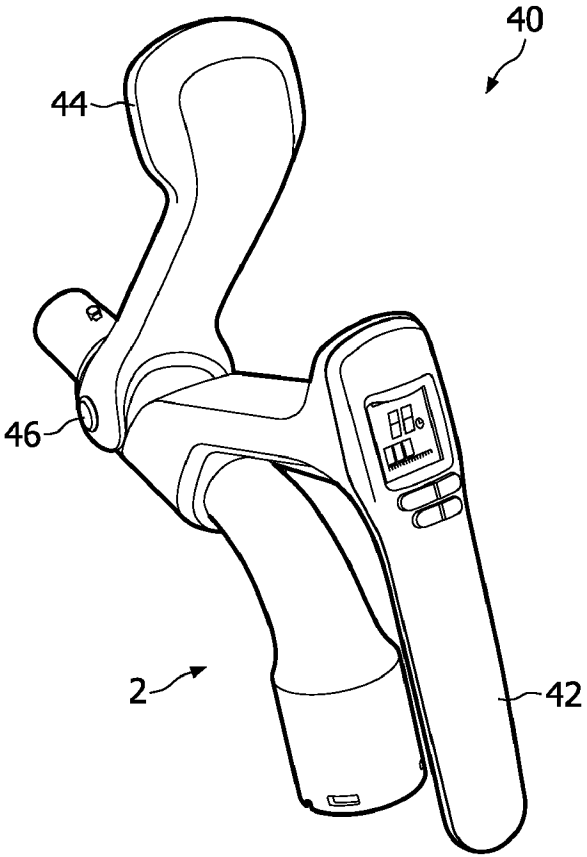

FIGS. 4A and B are perspective views of a handgrip assembly 40 connected to a tube assembly 2 in accordance with a second embodiment. The handgrip assembly comprises two handgrips 42, 44 which are arranged to hinge relatively to each other via a hinge 46.

In FIG. 4A, the handgrip assembly 40 is in an open position in which the first and second handgrip portions are provided. In FIG. 4B, the handgrip assembly is in a closed position in which the first and second handgrips 42, 44 combine so as to provide a unitary handgrip. In the closed position, the first and the second handgrip are substantially aligned. This is especially advantageous when storing the suction attachment.

The invention relates to a suction attachment, a handgrip assembly and a vacuum cleaner. The suction attachment comprises a tube assembly, a first handgrip, and a second handgrip, respectively, both of which extend from the tube assembly. This provides two handgrip portions separate from the tube assembly, which improves its ergonomic handling.

It will be clear to a person skilled in the art that the scope of the present invention is not limited to the examples described hereinbefore, but that several amendments and modifications are possible without departing from the scope of the present invention as defined in the appendent claims. While the present invention has been illustrated and described in detail in the Figures and the description, such illustrations and description are to be considered illustrative or as examples only, and are not restrictive. The present invention is not limited to the disclosed embodiments. Variants of the disclosed embodiments can be understood and effected by a person skilled in the art in practicing the claimed invention, from a study of the Figures, the description and the appendent claims. In the claims, use of the verb "comprise" and its conjugations does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

The invention claimed is:

1. A suction attachment for a vacuum cleaner, said suction attachment comprising:

a suction nozzle;

a tube assembly attached to the suction nozzle, said tube assembly defining a passageway in communication with an interior of the suction nozzle; and a first handgrip extending from the tube assembly so as to provide a first handgrip portion separate from the tube assembly, wherein the suction attachment further comprises:

a second handgrip extending from the tube assembly between the first handgrip and the suction nozzle so as to provide a second handgrip portion separate from the tube assembly, the first handgrip and the second handgrip being arranged to handle the suction attachment by both hands of a user during operation, and wherein the first and the second handgrip are arranged to hinge relatively to each other between an open position so as to provide said first and second handgrip portions, and a closed position in which the first and the second handgrip are combined so as to provide a unitary handgrip.

2. The suction attachment as claimed in claim 1, wherein the first or the second handgrip comprises a base part connected to the tube assembly and adapted to surround a respective portion of the tube assembly.

3. The suction attachment as claimed in claim 1, wherein the base part comprises a holder which is arranged to hold suction accessories in a detachable manner.

4. A suction attachment for a vacuum cleaner, said suction attachment comprising:

a suction nozzle;

a tube assembly attached to the suction nozzle, said tube assembly defining a passageway in communication with an interior of the suction nozzle; and a first handgrip extending from the tube assembly so as to provide a first handgrip portion separate from the tube assembly, wherein the suction attachment further comprises:

a second handgrip extending from the tube assembly between the first handgrip and the section nozzle so as to provide a second handgrip portion separate from the tube assembly, the first handgrip and the second handgrip being arranged to handle the suction attachment by both hands of a user during operation, wherein the first handgrip and the second handgrip are arranged to adjust the distance between the handgrip portions and the tube assembly.

5. The suction attachment as claimed in claim 1, wherein the tube assembly comprises a rigid part connected to the suction nozzle, a flexible part for connection to the housing of a vacuum cleaner, and a bridging part for connecting the rigid part to the flexible part, respectively, the first handgrip being connected to the bridging part and the second handgrip being connected to the rigid part.

6. The suction attachment as claimed in claim 5, wherein the flexible part is connected to the bridging part so as to allow rotation through a predefined range between the flexible part, on the one hand, and the bridging part and the first handgrip, on the other hand.

7. The suction attachment as claimed in claim 6, wherein the predefined range is 180°.

8. The suction attachment as claimed in claim 5, wherein the bridging part has an extension which couples with the interior of the rigid part so as to attach the bridging part to the rigid part.

9. A vacuum cleaner comprising a housing with a control unit for controlling the operation of the vacuum cleaner, an electrical suction unit for providing vacuum power, and a dust container, wherein the housing is connected to the suction attachment as claimed in claim 1.

10. The vacuum cleaner as claimed in claim 9, wherein the first handgrip or the second handgrip comprises a control display which is electrically connected to the control unit for controlling the operation of the vacuum cleaner via the control display.

11. The vacuum cleaner as claimed in claim 10, wherein a wireless electrical connection between the control unit and the control display is provided.

12. A handgrip assembly comprising a first handgrip and a second handgrip to be used in the suction attachment as claimed in claim 1.

* * * * *